United States Patent [19]

Chan

[11] Patent Number: 4,536,641

[45] Date of Patent: Aug. 20, 1985

[54] IRON WITH OVERTEMPERATURE PROTECTION MEANS

[75] Inventor: Ven L. Chan, Singapore, Singapore

[73] Assignee: Black & Decker, Inc., Newark, Del.

[21] Appl. No.: 574,295

[22] Filed: Jan. 26, 1984

[51] Int. Cl.[3] ..... D06F 75/26; H05B 1/02; H01H 37/76

[52] U.S. Cl. ..... 219/253; 38/77.83; 219/517; 337/3; 337/403; 337/407; 337/414

[58] Field of Search ..... 219/517, 251–253; 337/3, 4, 401–416; 38/82, 77, 83

[56] References Cited

U.S. PATENT DOCUMENTS

| | | | |
|---|---|---|---|
| 1,264,868 | 4/1918 | Carlson | 337/403 |
| 1,615,742 | 1/1927 | Collins et al. | 337/403 |
| 1,762,064 | 6/1930 | Kyle | 337/403 X |
| 2,041,362 | 5/1936 | McIlveney | 337/414 |
| 2,553,274 | 5/1951 | Pohl | 219/517 X |
| 3,301,981 | 1/1967 | Urani | 337/404 |
| 3,423,567 | 1/1969 | Mills | 219/517 X |
| 3,496,661 | 2/1970 | Davidson et al. | 38/77.83 |
| 3,665,152 | 5/1972 | Foster et al. | 219/253 |
| 3,747,241 | 7/1973 | Davidson | 38/77.83 |
| 3,952,274 | 4/1976 | Plasko | 337/407 |
| 4,130,954 | 12/1978 | Walker | 38/77.83 |
| 4,277,900 | 7/1981 | Gowdy | 38/77.83 |
| 4,366,462 | 12/1982 | Hollweck | 337/409 |
| 4,415,796 | 11/1983 | Balchunas | 219/253 |
| 4,433,231 | 2/1984 | Balchunas | 219/253 |

FOREIGN PATENT DOCUMENTS

| | | | |
|---|---|---|---|
| 2521770 | 8/1983 | France | 219/253 |
| 278234 | 10/1927 | United Kingdom | 337/401 |

*Primary Examiner*—A. Bartis

*Attorney, Agent, or Firm*—Leonard J. Platt

[57] ABSTRACT

A thermostatically controlled electric flatiron having a heater circuit of sufficient wattage to achieve abnormally high soleplate temperatures on continuous operation is provided with an overtemperature protection assembly for opening the heater circuit before damaging high soleplate temperature occurs on thermostat failure. The assembly includes first and second members connected in the heater circuit and electrically isolated from the soleplate and each other bridged by a third spring-biased circuit member to complete the heater circuit. A slug of eutectic alloy forms a fusible joint bonding the third member intermediate its ends to one of the first and second members to hold the third member against the spring bias in circuit completing contact with the first and second. The fusible joint has a melting point above the maximum operating temperature of the flatiron but less than the abnormally high temperature and is out of the heater circuit so that the fusible joint is not a current carrying element and there is no local heat generated therein by joint resistance and operation of the assembly is not influenced by any variable joint resistance.

7 Claims, 7 Drawing Figures

IRON WITH OVERTEMPERATURE PROTECTION MEANS

BACKGROUND OF THE INVENTION

1. Field of the Invention

The invention herein pertains to an overtemperature control or protection means incorporated substantially in any type of electric flatiron to protect the soleplate from overheating in the event of failure or inability of the thermostat to open the electrical circuit.

2. Description of the Prior Art

In irons of the various types available today, such as conventional dry flatirons or irons with steam and/or spray features, a thermostat is used to open and close the circuit to the electric heater and thus control the temperature of the soleplate in accordance with selected temperatures for various fabrics to be ironed. There is always a danger, although slight, of some failure upon which the thermostat cannot open the electrical circuit with the result that the iron may overheat. Typically, irons are made with aluminum soleplates that may be polished, coated with a non-stick surface or with stainless steel but the main body of the soleplate is aluminum. The aluminum casting will become dangerously hot and soften and start to melt between 900° and 1100° F. Thus, it has generally been necessary to consider the maximum temperature of such irons as about 900° F. Additionally, current irons use much lower melting plastic housings in place of the former metallic housings, so are subject to melting of such housings in addition to the softening or melting of the soleplate.

Prior art irons have used the equivalent of a fuse in the line in order to avoid overtemperature conditions, but this has not been satisfactory because of unreliability of the fuse and the inability of the designers to provide a device that can be mass produced with reliable repetition. A typical overtemperature protection means for use with irons, that has been successfully mass produced on a large scale, is disclosed and claimed in U.S. Pat. No. 3,665,152 of common assignment. It discloses a current and successful version of an overtemperature protection means as used in assignee's irons for numerous years. It also sets forth the necessary parameters and problems encountered in possible overheating of irons and discloses an overtemperature control to prevent melting of the soleplate. This is the best known prior art applicable to the instant invention and reference is made thereto for a complete background of the problem and solution. The present invention is an improvement on that patent and, structurally, provides an arrangement wherein the fusible soldered joint of the prior art is a non-electrical current carrying element and the joint is used instead as a hold-down for a spring blade which bridges the two terminals of the overtemperature limiter.

SUMMARY OF THE INVENTION

Briefly described, the present invention is directed to an electric flatiron having a heater circuit of sufficient wattage to achieve abnormally high soleplate temperatures on continuous heater operation and a thermostat controlling the soleplate temperature to a normal selected operating temperature and which has an overtemperature protection assembly to open the heater circuit before high soleplate temperature occurs on thermostat failure. To this general combination, an improvement is provided in the assembly including first and second circuit members in the heater circuit and electrically isolated from the soleplate and from each other. A third spring-biased circuit member is provided bridging and contacting each of the first and second members and a fusible joint is disposed to hold the third member against the bias in contact with the first and second members completing a circuit through the members. The structure or combination is arranged so that the joint is disposed adjacent to the third member and out of the circuit such that, on melting, the third spring member is snapped out of contact to open the circuit and the fusible joint is not part of the circuit but merely a connector or hold-down for the third or spring-biased member. Two embodiments are shown to carry out the invention. Thus, the main object is to provide a reliable overtemperature protection means to act in addition to the thermostat to disconnect the power supply to prevent excessive soleplate temperatures and to do this with a spring-biased member that is held in contact in the circuit by a fusible joint that is external and not part of the electric circuitry and thus not subject to heat in the joint generated by normal joint resistance.

DESCRIPTION OF THE PREFERRED EMBODIMENT

Figure 1:
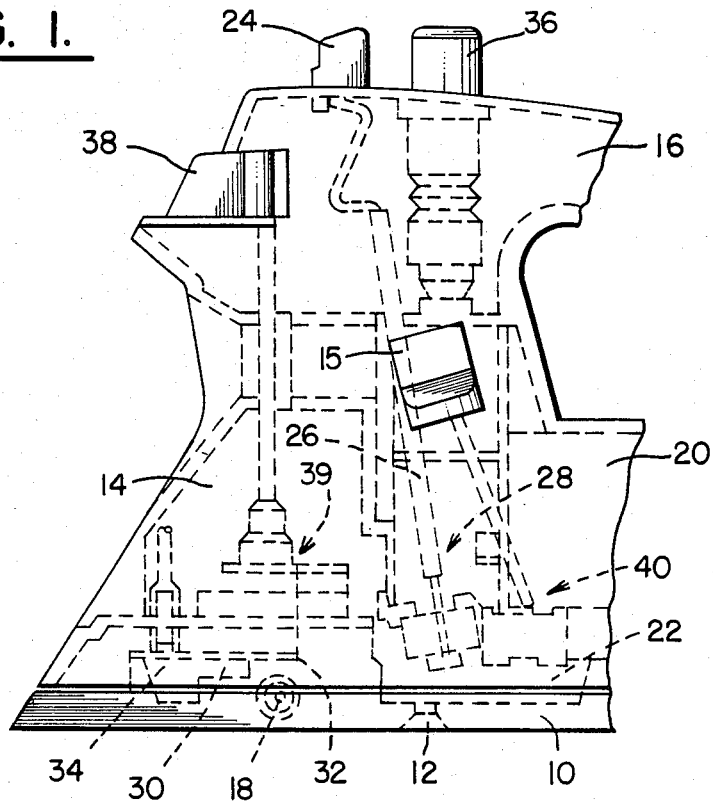
FIG. 1 an elevation view, partially in section and phantom, illustrating a typical iron with the invention applied.

Referring first to FIG. 1, there is shown a typical electric flatiron of the type to which this invention may be applied although the overtemperature control may be applied to any electric flatiron, from the basic dry iron to various deluxe models having steaming, spraying, and other features. Shown is a steam iron of the self-cleaning variety as shown in U.S. Pat. No. 3,747,241 of common assignment. As such, the iron includes a soleplate 10 that generally is cast aluminum which melts when the soleplate temperature becomes abnormally high—in the range of 900° F. to 1100° F. and will generally operate at a normal maximum continuous selected soleplate temperature in the order of about 550° F. which is the normal maximum cycle temperature for a linen setting. The normal thermostatic dial settings of an iron allow for a range of soleplate operating temperatures. Above the normal operating range, if continuous heat is applied the soleplate is subjected to conditions where heat is generated faster than it is dissipated, and an abnormally high soleplate temperature occurs. This is the definition as used herein. Soleplate 10 has a plurality of steam ports 12 and an outer shell 14 which encloses various components within the iron and which may be plastic with a forward riser portion 15 which, with shell 14 is connected to extend into handle 16 in known fashion. The soleplate 10 is generally cast aluminum with electric heating element 18 cast in position and disposed so uniform heat distribution is provided when the iron is plugged in and activated.

The iron includes means for generating steam by providing water tank 20 that is an inner part of the preferably single plastic housing shell 14 secured to soleplate 10 in a known manner. For steam, soleplate 10 has steam generator 22 into which, under control of button 24 and guided valve stem 26 movable between an on/off position, water controllably drips from tank 20 onto hot soleplate 10 through metering water valve 28 of the type in U.S. Pat. No. 3,496,661 of common assignment, the resulting steam being distributed through passages 30 under coverplate 32 and out ports 12 onto the fabric being ironed. In the embodiment shown, an additional surge is provided by injecting water into a separate forward generator 34 by control button 36. Slide control 38 operates thermostat 39 to set the soleplate heat. The structure thus far described is generally well known and is typical of the type of iron shown in U.S. Pat. No. 4,277,900 of common assignment. One of the main features in the self-cleaning iron is provision for suddenly and completely dumping tank 20 onto the hot soleplate through a substantially large opening that preferably, although not necessarily, is spaced and separate from the usual metering water valve 28. Controlling this large opening, a dumper valve 40 is disposed in the bottom of the water tank to quickly empty the tank onto the soleplate where the combination of hot water and steam suddenly created forcefully purges or cleans the internal passages and distribution system, tank, and ports 12 of lint and internal deposits. A dump valve structure is shown in U.S. Pat. No. 4,130,954 of common assignment.

Figure 2:
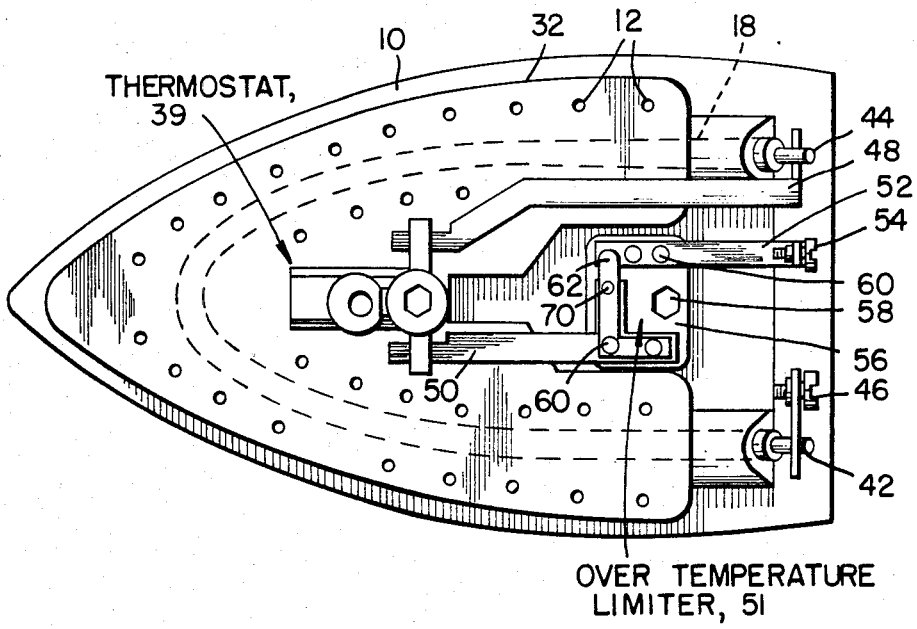
FIG. 2 a plan view partially in phantom showing a soleplate with the preferred form of the invention.

As fully described in U.S. Pat. No. 3,665,152 on which the present invention improves, heating element 18 is a coiled resistance wire formed typically in a helix. This resistance wire is held in spaced relation within an outer protective sheath by a mass a highly compact electrical insulating material such as granulated magnesium oxide. This is generally indicated by heater element 18. At each end of the heater element 18 the internal resistance wire is connected in any appropriate fashion to terminal pins 42 and 44 as seen in FIG. 2. The current flow is typically, from one side of the line into terminal 46 through terminal pin 42, through heating element 18 and out terminal pin 44, through connector 48, through thermostat 39 and out through a first circuit member 50, then through the specific overtemperature limiter structure generally indicated as 51, and out a second circuit member 52 to terminal 54 and the other side of the line thus completing the circuit through heating element 18.

In said U.S. Pat. No. 3,665,152, the limiter of FIG. 3 has similar circuit elements with spring strip and connector soldered together by eutectic alloy which has a composition and a melting point at least as high as a normal maximum temperature and less than any abnormally high temperature all as determined by the selected iron operating conditions. This is selected such that, on melting of the eutectic, the parts separate to snap-break the circuit at the securement point. This means the eutectic is part of the actual electric circuit and thus is a current-carrying element which, under heat, generates a joint resistance and which resistance can vary from one assembly to the next.

Figure 3:
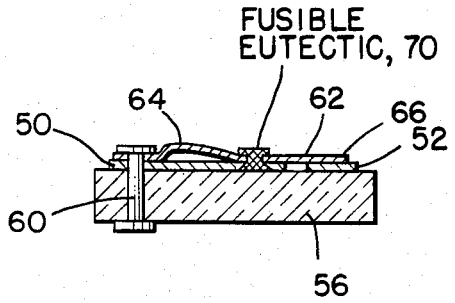
FIG. 3 is a partial enlarged sectional view on line 3—3 of FIG. 4 with the circuit completed.
Figure 4:
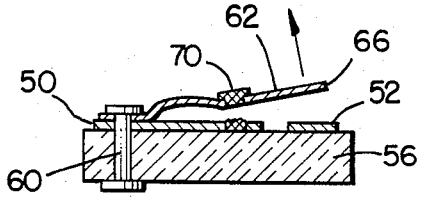
FIG. 4 is an enlarged plan view of the preferred form of FIG. 2.
Figure 5:
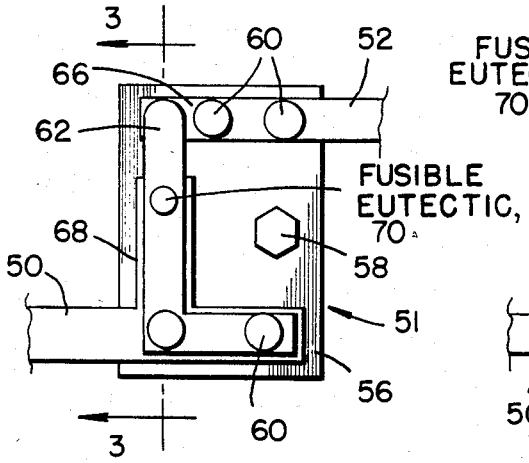
FIG. 5 is a view, similar to FIG. 3, showing the open circuit position.

In accordance with the invention, the arrangement as shown in FIG. 3 of said U.S. Pat. No. 3,665,152 patent is improved by the structure to be described thus avoiding the use of the eutectic as a current-carrying element in the overtemperature limiter. In order to avoid this, a preferred structure as shown in FIGS. 3–5 herein is employed.

Figure 6:
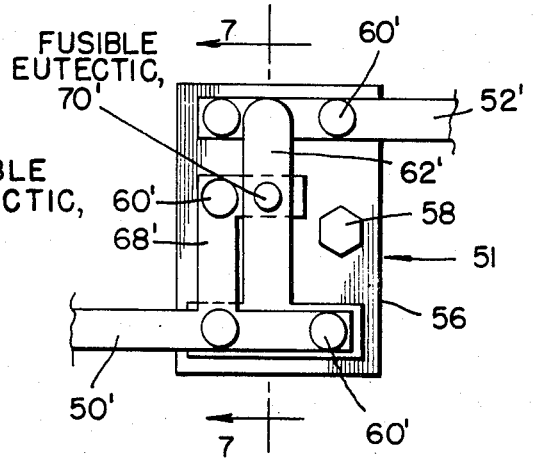
FIG. 6 is a view, similar to FIG. 4, showing an alternate form of the invention.
Figure 7:
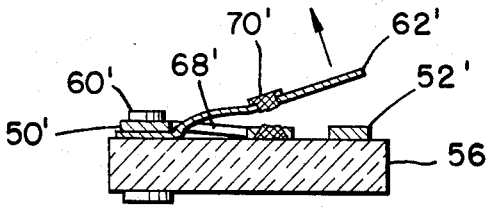
FIG. 7 is a view, similar to FIG. 5, on line 7—7 of FIG. 6 showing the open circuit position of the alternate form.

In order to isolate the various circuit members from the metallic soleplate, a ceramic insulating block 56 is mounted directly on the soleplate such as by bolt 58 to raise and support various circuit members as will be apparent. The preferred overtemperature assembly has a first elongated metallic blade member 50, as shown in FIGS. 2 and 4, that is directly connected to the thermostat 39 at one end as shown and is plural-riveted at 60 to the insulating block. An additional elongated metallic second circuit member 52 is connected to the other side of the block by similar rivets 60 and to terminal 54 such that the first and second members 50 and 52 are electrically isolated from the soleplate and from each other by their disposition on insulating block 56. Since these circuit members 50 and 52 are electrically conducting members through the heater circuit, it is necessary to series connect the two together. This is accomplished by a third circuit member 62 that, in the preferred embodiment of FIGS. 2 and 4, is L-shaped so that it may be secured also by rivets 60 directly overlapping the first member 50 as shown. In order to provide a break in the series circuit, the third member 62 is formed with a preset or preformed curve 64 in FIG. 3 to provide a built-in bias so that its free end 66 is urged away from electrical connection to the other members 50 and 52. Thus, the circuit members are all elongated suitably-shaped metallic blades and the third member 62 extends parallel and adjacent at least one of the members 52 and 50 (the parts could be reversed). The parallel and adjacent relationship is also shown in an alternate form in FIGS. 6 and 7 where a different shape of third member 62' is just another way of forming an overlap between the circuit members. Thus, the different shaped overlapping portions 68 and 68' are equivalent variations of circuit members 50 and 50' respectively.

In order to complete the series circuit between members 52 and 50 by means of third member 62, an alloy sensor or solder 70 of eutectic composition with a melting point at least as high as the normal maximum temperature of the iron and less than any abnormally high temperature and this eutectic is disposed somewhere between the two ends of the third circuit member 62 and opposes the built-in bias to hold the parts in series connection. It can be seen that the third circuit member 62 is preferably a spring steel blade that snaps apart on melting of the eutectic. The eutectic 70 and 70', in both the FIG. 4 and FIG. 6 modifications connects the third member 62 and 62' between its ends in the parallel and adjacent portion with the first member 68 and 68'. Both modifications are equivalent, and the solder holds other end 66 of the third member in contact with the second member 52 and 52'. Both modifications provide an overlap as shown and it is at this overlap that the eutectic 70 and 70' is disposed. Clearly, it will be apparent that it is now a non-electrical hold-down feature and completely out of the electric circuit.

With the described arrangement, since the fusible joint or eutectic is not a current-carrying element there is no local heat in the joint generated by joint resistance so that the operation of the overtemperature limiter is not affected by any variable joint resistance. Additionally, when the eutectic is part of the circuit, occasionally there is a track formed by melted solder across the contacting terminals when the circuit opens to prevent a clean opening of the circuit which defeats the function of the overtemperature limiter. With the modifications of FIGS. 4 and 6 any tracks at the eutectic joint do not affect the breaking of the circuit. Also, since the overtemperature limiter is non-cycling, it requires only a very thin silver plating or even a tin plating with a mild contact pressure which pressure comes from the preformed curve 64 of third circuit member 62 and the hold-down fusible eutectic 70. Lastly, since the fusible eutectic joint is not a current-carrying element, the electrical conductance of the joint is not a factor for consideration. This allows wider options for processes and selection of materials. For instance, a non-conductive material with a set fuse point can also be used to form the hold-down in place of the eutectic illustrated.

In summary, the concept of the invention is to use the fusible eutectic joint as a means to hold down the spring third circuit member 62 which bridges across to connect the two terminals and 46 and 54. Either of the modifications or equivalent others may be sufficient as will be apparent.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In an electric flatiron having a heater circuit of sufficient wattage to achieve abnormally high soleplate temperatures on continuous heater operation, a thermostat controlling the soleplate temperature to a normal selected operating temperature, an overtemperature protection assembly to open the heater circuit before high soleplate temperature occurs on thermostat failure, an improvement in said assembly including, first and second circuit members in said heater circuit and electrically isolated from the soleplate and each other, a third spring-biased circuit member bridging and contacting each of said first and second members, a fusible joint including a slug of eutectic alloy directly bonding the third member to one of the first and second members, said alloy slug holding said third member against said bias in contact with said first and second members completing a circuit through said members, said fusible joint having a melting point above the maximum normal operating temperature of the iron, but less than the abnormally high temperature, said joint disposed intermediate ends of the third member and out of said circuit so, on melting, the third spring-biased member is snapped out of contact to open the circuit.

2. Apparatus as described in claim 1 wherein said third member bridges and contacts said first and second members at its ends and said joint is disposed between the contact points.

3. In an electric flatiron with a soleplate and associated electric heater circuit of sufficient wattage to achieve abnormally high soleplate temperatures upon continuous heater operation, a thermostat limiting the soleplate temperature to a normal maximum selected operating temperature by switching of the electric power supply to the electric heater, that improvement comprising, an overtemperature protection assembly to disconnect the heater from electric power before abnormally high soleplate temperatures occur on thermostat failure, said assembly including:

first and second circuit members in said heater circuit electrically connecting in said heater circuit and electrically isolated from said soleplate and each other, a third circuit member electrically connected by its ends between said first and second members and completing a series circuit therethrough, said third member formed to bias one end away from electrical connection to one of said first and second members, an alloy sensor having essentially eutectic composition and a melting point at least as high as said normal maximum temperature and less than any abnormally high temperature formed as a slug of alloy and disposed between said ends and opposing said bias to secure said one end in said electrical connection to said one of said first and second members, said slug of eutectic alloy directly bonding said third member to one of said first and second members without being part of the electrical circuit through said members, said assembly being mounted on the flat iron so that said alloy sensor is subject to soleplate heat and, on melting under abnormal heat, breaks said securement between the third member and said one of said first and second members to open the circuit and shut off the iron before soleplate overheat.

4. In an electric flatiron with a soleplate and associated electric heater circuit of sufficient wattage to achieve abnormally high soleplate temperatures upon continuous heater operation, a thermostat limiting the soleplate temperature to a normal maximum selected operating temperature by switching of the electric power supply to the electric heater, that improvement comprising, an overtemperature protection assembly to disconnect the heater from electric power before abnormally high soleplate temperatures occur on thermostat failure, said assembly including:

first and second circuit members in said heater circuit electrically connected in said heater circuit and electrically isolated from said soleplate and each other, a third circuit member electrically connected by its ends between said first and second members and completing a series circuit therethrough, said third member formed to bias one end away from electrical connection to one of said first and second members, an alloy sensor having essentially eutectic composition and a melting point at least as high as said normal maximum temperature and less than any abnormally high temperature formed as a slug of alloy and disposed between said ends and opposing said bias to secure said one end in said electrical connection to said one of said first and second members, said assembly being mounted on the flatiron so that said alloy sensor is subject to soleplate heat without being part of the electrical circuit through said members and, on melting under abnormal heat, breaks said securement between the third member and said one of said first and second member to open the circuit and shut off the iron before soleplate overheat, said members being elongated metallic blades and said third member extending parallel and adjacent at least one of the other members and secured thereto between its ends by said eutectic.

5. Apparatus as described in claim 4 wherein an insulating block is mounted on the soleplate and said circuit members are individually mounted on said block for said electrical isolation from the soleplate.

6. Apparatus as described in claim 5 wherein said third member is a spring steel blade fastened at one end to said block and said first member with a pre-set bias away from contact with said second member at its other end and wherein the first member includes a blade portion positioned parallel to and closely adjacent to said spring steel blade, said alloy sensor connecting the third member between its ends to the parallel and adjacent portion of said first member to hold said other end in contact with the second member and forming a non-electrical hold-down for the spring steel blade.

7. Apparatus as described in claim 6 wherein said third member overlaps said first member at the slug of alloy to secure said one end thereof in said electrical connection to said one of said first and second members.

* * * * *